US006416916B1

(12) United States Patent
Silence et al.

(10) Patent No.: US 6,416,916 B1
(45) **Date of Patent: *Jul. 9, 2002**

(54) TONER AND DEVELOPER FOR MAGNETIC BRUSH DEVELOPMENT SYSTEM

(75) Inventors: Scott M. Silence, Fairport; Edward J. Gutman; James M. Proper, both of Webster; Frank O. Reitze; Brian S. Giannetto, both of Rochester; Brian E. Moore, Ontario; Joo T. Chung, Webster; James G. Stenzel, Rochester; Jeffrey L. DeBarr, Williamson; Morris M. DeYoung, Jr., Farmington, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/668,734

(22) Filed: Sep. 25, 2000

Related U.S. Application Data

(63) Continuation-in-part of application No. 09/520,360, filed on Mar. 7, 2000, now Pat. No. 6,319,647.

(51) Int. Cl.[7] ..... G03G 9/097

(52) U.S. Cl. ..... 430/108.3; 430/108.6; 430/108.7; 430/109.4; 430/111.4

(58) Field of Search ..... 430/108.3, 108.7, 430/108.6, 109.4

(56) References Cited

U.S. PATENT DOCUMENTS

| | | | | |
|---|---|---|---|---|
| 3,590,000 A | | 6/1971 | Palermiti et al. | |
| 3,981,272 A | | 9/1976 | Smith et al. | |
| 4,155,329 A | | 5/1979 | Tsukamoto et al. | |
| 4,298,672 A | | 11/1981 | Lu | |
| 4,338,390 A | | 7/1982 | Lu | |
| 4,375,673 A | | 3/1983 | Lewis et al. | |
| 4,465,730 A | | 8/1984 | Okada | |
| 4,558,108 A | | 12/1985 | Alexandru et al. | |
| 4,640,129 A | * | 2/1987 | Miyakawa et al. | 222/DIG. 1 |
| 4,725,521 A | * | 2/1988 | Shiegta et al. | 430/110 |
| 4,935,326 A | | 6/1990 | Creatura et al. | |
| 4,937,166 A | | 6/1990 | Creatura et al. | |
| 4,943,507 A | * | 7/1990 | Takahashi et al. | 430/110 |
| 4,985,328 A | * | 1/1991 | Kumagai et al. | 430/110 |
| 5,196,803 A | | 3/1993 | Cellini, Jr. et al. | |
| 5,225,304 A | * | 7/1993 | Kabashima et al. | 430/110 |
| 5,227,460 A | | 7/1993 | Mahabadi et al. | |
| 5,236,629 A | | 8/1993 | Mahabadi et al. | |
| 5,248,581 A | * | 9/1993 | Nakayama et al. | 430/110 |
| 5,260,160 A | * | 11/1993 | Aoki et al. | 430/110 |
| 5,272,038 A | * | 12/1993 | Mastubara et al. | 430/110 |
| 5,334,474 A | * | 8/1994 | Abbott et al. | 430/110 |
| 5,345,298 A | | 9/1994 | Corrigan, Jr. | |
| 5,416,566 A | | 5/1995 | Edmunds et al. | |
| 5,494,768 A | * | 2/1996 | Boswell et al. | 430/110 |
| 5,545,501 A | | 8/1996 | Tavernier et al. | |
| 5,556,732 A | * | 9/1996 | Chow | 430/109 |
| 6,004,714 A | * | 12/1999 | Ciccarelli et al. | 430/110 |
| 6,319,647 B1 | * | 11/2001 | Gutman et al. | 430/108.3 |

OTHER PUBLICATIONS

Diamond, Arthur S. (Editor) Handbook of Imaging Materials. New York: Marcel–Dekker, Inc. pp. 162–165, 168,169, 178,179. (1991).*

R. J. Nash, and J. T. Bickmore, "Toner Impaction and Triboelectric Aging", 4$^{th}$ International Congress on Advances in Non–Impact Printing Technology, R. J. Nash, ed., IS&T, Springfield, VA, pp. 113–126 (1988).

E. J. Gutman and G. C. Hartmann, Journal of Imaging Science and Technology, vol. 36, No. 4, Jul./Aug. 1992, pp. 335–349.

* cited by examiner

*Primary Examiner*—Christopher Rodee
(74) *Attorney, Agent, or Firm*—Oliff & Berridge, PLC; Eugene O. Palazzo

(57) ABSTRACT

A toner of toner particles containing at least one binder, at least one color ant, and an external additive package comprised of zinc stearate and at. least one of silicon dioxide or titanium dioxide, wherein the amount of zinc stearate is limited to about 0.10 percent by weight or less of the toner. It has been surprisingly found that when the amount of zinc stearate is so limited, a developer formed from the toner exhibits excellent triboelectric charging and stability and excellent developer flow. When the developer is used in a magnetic brush development system, consistent, high quality copy images are formed substantially without any depletion defects over time.

17 Claims, No Drawings

TONER AND DEVELOPER FOR MAGNETIC BRUSH DEVELOPMENT SYSTEM

This application is a Continuation-in-Part of application Ser. No. 09/520,360 field Mar. 7, 2000, now U.S. Pat. No. 6,319,647.

BACKGROUND OF THE INVENTION

1. Field of Invention

This invention relates to toners, developers containing the toners, and a method of forming images with the developers utilizing a magnetic brush development system. More in particular, the invention relates to toners and developers having carefully controlled properties to provide superior print quality, while substantially avoiding/eliminating depletion defects, when used in developing electrostatic images with a magnetic brush development system.

2. Description of Related Art

U.S. Pat. No. 5,545,501 describes an electrostatographic developer composition comprising carrier particles and toner particles with a toner particle size distribution having a volume average particle size (T) such that 4 $\mu$m$\leqq$T$\leqq$12 $\mu$m and an average charge (absolute value) pro diameter in femtocoulomb/10 $\mu$m ($C_T$) after triboelectric contact with said carrier particles such that 1 fC/10 $\mu$m$\leqq C_T \leqq$10 fC/10 $\mu$m characterized in that (i) said carrier particles have a saturation magnetization value, $M_{sat}$, expressed in Tesla (T) such that $M_{sat} \geqq 0.30$ T, (ii) said carrier particles have a volume average particle size ($C_{avg}$) such that 30 $\mu$m$\leqq C_{avg} \leqq$60 $\mu$m, (iii) said volume based particle size distribution of said carrier particles has at least 90% of the particles having a particle diameter C such that 0.5 $C_{avg} \leqq C \leqq 2\ C_{avg}$, (iv) said volume based particles size distribution of said carrier particles comprises less than b % particles smaller than 25 $\mu$m wherein $b=0.35\times(M_{sat})^2\times P$ with $M_{sat}$: saturation magnetization value, $M_{sat}$, expressed in T and P: the maximal field strength of the magnetic developing pole expressed in kA/m, and (v) said carrier particles comprise a core particle coated with a resin coating in an amount (RC) such that 0.2% w/w$\leqq$RC$\leqq$2% w/w. See the Abstract. This patent describes that such developer achieves images of offset-quality in systems in which a latent image is developed with a fine hair magnetic brush.

Xeikon NV currently supplies the market with developers for magnetic brush development systems. These developers are comprised of toner and carrier particles. The toner is believed to be comprised of pigments and two polyesters, a propoxylated bisphenol-A, hexanedioic acid, isophthalic acid polyester and an ethoxylated bisphenol-A ethylene glycol, isophthalic acid, terephthalic acid polyester, while the carrier is believed to be comprised of an iron-zinc-copper oxide core coated with a crosslinked siloxane. However, such developers suffer from lower triboelectric stability and image quality stability, and insufficient color gamut.

Co-pending U.S. patent application Ser. No. 09/520,360, filed Mar. 7, 2000 now U.S. Pat. No. 6,319,647 and incorporated by reference herein in its entirety, describes a toner that performs better than the Xeikon NV toners. The toner contains at least one binder, at least one colorant, and preferably one or more external additives of one or more of silicon dioxide powder, untreated titanium dioxide powder and zinc stearate (in amounts of at least 0.1 percent by weight of the toner). The toner particles, following triboelectric contact with carrier particles, exhibit a charge per particle diameter (Q/D) of from 0.6 to 0.9 fC/$\mu$m and a triboelectric charge of from 20 to 25 $\mu$C/g. The toner particles preferably have an average particle diameter of from 7.8 to 8.3 microns. The toner is combined with carrier particles to achieve a developer, the carrier particles preferably having an average diameter of from 45 to 55 microns and including a core of ferrite substantially free of copper and zinc coated with a coating comprising a polyvinylidene-fluoride polymer or copolymer and a polymethyl methacrylate polymer or copolymer. The carrier particles may be comprised of ferrite particles, which are preferably substantially free of both zinc and copper as described in co-pending U.S. patent application Ser. No. 09/444,701, filed Nov. 24, 1990 now U.S. Pat. No. 6,143,456, incorporated herein by reference in its entirety.

However, the toners designed to date for use in imaging devices employing a magnetic brush development system exhibit some degree of image depletion defect (characterized by insufficient toner being deposited on an image forming medium in an area of the image being reproduced) during operation of the device. Specifically, under conditions of high area coverage of toner in an imaged area (typically greater than 50% of a page covered by a single separation image), an area of decreased toner mass in an image can occur, running parallel to the process direction of the paper in the print engine. Generally this decreased toner mass, or image density depletion, will become more pronounced as more prints are made, increasing in both the spatial extent of the defect and in the difference in developed toner mass (with respect to the target developed mass) within the defect area degree of depletion. In extreme cases, the image may be completely absent in a band in the xerographic process direction which encompasses one third to one half of the intended image. What is still desired is a set of developers comprised of toners and carriers that possess not only high stable triboelectric performance, but also do not exhibit image depletion defects when used to develop a latent image on the surface of a photoreceptor with a magnetic brush.

SUMMARY OF THE INVENTION

It is one object of the present invention to provide a set of color toners and developers that substantially avoid/eliminate the occurrence of image depletion defects while maintaining high and stable triboelectric performance, particularly when used in developing images with a magnetic brush.

It is a further object of the invention to obtain toners and developers having superior triboelectric and image quality stability.

It is a still further object of the invention to form images utilizing a magnetic brush with the developers of the invention, which images have superior quality compared to conventional magnetic brush developers and which images are substantially free of image depletion defects.

These and other objects are achieved in the present invention, in which it has been determined that the presence of higher amounts of zinc stearate as an external additive to a toner results in the developer having poor developer flow, which in turn results in the occurrence of image depletion defects.

In one aspect of the invention, the invention pertains to toner particles containing at least one binder, at least one colorant, and an external additive package comprised of zinc stearate and at least one of silicon dioxide or titanium dioxide, wherein the amount of zinc stearate is limited to no more than about 0.10 percent by weight of the toner. It has been surprisingly found that when the amount of zinc stearate is so limited, a developer formed from the toner exhibits excellent triboelectric charging and stability and excellent developer flow. When the developer is used in a magnetic brush development system, consistent, high quality copy images are formed substantially without any depletion defects over time.

In a further aspect of the invention, the invention relates to a particular toner design comprised of toner particles comprised of at least one binder resin comprising a propoxylated bisphenol A fumarate resin, at least one colorant comprising pigment selected from the group consisting of cyan, yellow, magenta and black, wherein if the pigment is cyan, magenta or black, the binder resin has a gel content of from about 5 to about 18 percent by weight of the binder resin and if the pigment is yellow, the binder resin contains no gel, and an external additive package comprised of zinc stearate and at least one of silicon dioxide or titanium dioxide, wherein the zinc stearate is present in an amount of no more than about 0.10 percent by weight of the toner.

In a still further aspect of the invention, the toner is combined with carrier particles to form a developer possessing the high and stable triboelectric performance and flow properties discussed above.

In a still further aspect of the invention, the invention pertains to an electrophotographic image forming apparatus comprising a photoreceptor, a magnetic brush development system, and a housing in association with the magnetic brush development system and containing the developer of the invention.

DETAILED DESCRIPTION OF PREFERRED EMBODIMENTS

Generally, the process of electrophotographic printing includes charging a photoconductive member to a substantially uniform potential to sensitize the surface thereof. The charged portion of the photoconductive surface is exposed to a light image from, for example, a scanning laser beam, an LED source, etc., or an original document being reproduced. This records an electrostatic latent image on the photoconductive surface of the photoreceptor. After the electrostatic latent image is recorded on the photoconductive surface, the latent image is developed.

In the present invention, two-component developer materials are used for development. A typical two-component developer comprises magnetic carrier granules having toner particles adhering triboelectrically thereto. Toner particles are attracted to the latent image, forming a toner powder image on the photoconductive surface. The toner powder image is subsequently transferred to a copy sheet. Finally, the toner powder image is heated to permanently fuse it to the copy sheet in image configuration.

A commonly known way of developing the latent image on the photoreceptor is by use of one or more magnetic brushes. See, for example, U.S. Pat. Nos. 5,416,566, 5,345,298, 4,465,730, 4,155,329 and 3,981,272, incorporated herein by reference. As described in these patents, the housing of an imaging device contains the developer. The developer is fed to the magnetic brush by way of augers which load a paddle wheel, the paddle wheel in turn loading the toner onto the magnetic brush.

The toner of the developer may be formulated to carry either a negative or positive charge, and is in any case selected vis-a-vis the carrier so that the toner particles acquire the proper operating charge with respect to the latent electrostatic image being developed. Thus, when the developer is brought into operative contact with the photoconductive surface of the photoreceptor, the greater attractive force of the charged image causes the toner particles to leave the carrier particles and adhere to the image portion of the plate.

The aforesaid magnetic brush typically is comprised of a roll having a tube-like member or sleeve, which is rotatably supported within the housing of the image forming device. The sleeve is preferably made from a non-magnetic material. One or more magnets are mounted inside the sleeve. The roll is disposed so that a portion of the sleeve is immersed in or in contact with a supply of developer comprising the carrier particles and the toner particles.

As a result, the developer is magnetically attracted to the surface of the sleeve and arranges thereupon in the form of a brush. Thus, when the photoreceptor bearing the latent electrostatic image thereon is brought into physical contact with the brush, the attractive force of the electrostatic charge on the photoreceptor surface in the image areas, which is greater than the force holding the toner to the carrier particles, draws the toner from the magnetic brush roller and onto the image areas to render the image visible.

The electrophotographic marking process given above can be modified to produce color images. In such a process, each color of the image is successively developed and transferred to an image receiving substrate, for example paper, thus forming an image-wise configuration of the developed image upon the substrate.

This invention describes the aspects of novel toners and developers that operate in the restrictive magnetic brush development environment to achieve image qualities superior to prior art toners and developers, the developers possessing better triboelectric stability and image quality stability. Color, solids, halftones, gloss, pictorials, text and background are stable over the entire job run.

By this invention, color toners and developers are achieved having the necessary properties to function in magnetic brush development systems without exhibiting image depletion defects during a print run. Four different color toners, cyan (C), magenta (M), yellow (Y) and black (K), are typically used in developing full color images (although other color toners may also be used). Each of these color toners in the present invention are preferably comprised of at least resin binder, appropriate colorants and an additive package comprised of specific additives. Suitable and preferred materials for use in preparing toners of the invention will now be discussed.

Illustrative examples of suitable toner resins selected for the toner and developer compositions of the present invention include vinyl polymers such as styrene polymers, acrylonitrile polymers, vinyl ether polymers, acrylate and methacrylate polymers; epoxy polymers; diolefins; polyurethanes; polyamides and polyimides; polyesters such as the polymeric esterification products of a dicarboxylic acid and a diol comprising a diphenol, crosslinked polyesters; and the like. The polymer resins selected for the toner compositions of the present invention include homopolymers or copolymers of two or more monomers. Polyester resins are the most preferred binder resins in the invention.

Illustrative examples of the dicarboxylic acid units in the polyester resins suitable for use in the toner compositions of the present invention include phthalic acid, terephthalic acid, isophthalic acid, succinic acid, glutaric acid, adipic acid, pimelic acid, suberic acid, azelaic acid, sebacic acid, maleic acid, fumaric acid, dimethyl glutaric acid, bromoadipic acids, dichloroglutaric acids, and the like; while illustrative examples of the diol units in the polyester resins include ethanediol, propanediols, butanediols, pentanediols, pinacol, cyclopentanediols, hydrobenzoin, bis(hydroxyphenyl) alkanes, dihydroxybiphenyl, substituted dihydroxybiphenyls, and the like.

As one toner resin, there are selected polyester resins derived from a dicarboxylic acid and a diphenol. These resins are illustrated in U.S. Pat. No. 3,590,000, the disclosure of which is totally incorporated herein by reference. Also, propoxylated polyester resins obtained from the reaction of bisphenol A and propylene oxide or propylene carbonate, and in particular including such polyesters followed by the reaction of the resulting product with fumaric acid, and branched polyester resins resulting from the reaction of dimethylterephthalate with 1,3-butanediol, 1,2-propanediol, and pentaerythritol, may also preferable be used. Further, low melting polyesters, especially those prepared by reactive extrusion, reference U.S. Pat. No. 5,227,460, the disclosure of which is totally incorporated herein by reference, can be selected as toner resins. Other specific toner resins may include styrene-methacrylate copolymers, styrenebutadiene copolymers, PLIOLITES™, and suspension polymerized styrenebutadienes (U.S. Pat. No. 4,558,108, the disclosure of which is totally incorporated herein by reference).

The most preferred resin binders for use in the present invention comprise polyester resins containing both linear portions and cross-linked portions of the type described in U.S. Pat. No. 5,227,460 (incorporated herein by reference above). The cross-linked portion of the binder consists essentially of microgel particles with an average volume particle diameter up to about 0.1 micron, preferably about 0.005 to about 0.1 micron, as determined by scanning electron microscopy and transmission electron microscopy, the microgel particles being substantially uniformly distributed throughout the linear portions. This resin may be prepared by a reactive melt mixing process as known in the art. The highly cross-linked dense microgel particles distributed throughout the linear portion impart elasticity to the resin, which improves the resin offset properties, while not substantially affecting the resin minimum fix temperature.

The toner resin is thus preferably a partially cross-linked unsaturated resin such as unsaturated polyester prepared by cross-linking a linear unsaturated resin (hereinafter called base resin) such as linear unsaturated polyester resin, preferably with a chemical initiator, in a melt mixing device such as, for example, an extruder at high temperature (e.g., above the melting temperature of the resin and preferably up to about 150° C. above that melting temperature) and under high shear.

The toner resin has a weight fraction of the microgel (gel content) in the resin mixture in the range typically from about 0 to about 50 weight percent, preferably from about 1 to about 20 weight percent, more preferably about 5 to about 18 weight percent, and most preferably about 10 to about 15 weight percent. In a most preferred embodiment of the present invention, the resin for magenta, black and cyan toners has a gel content of, for example, about 5 to about 18 percent by weight of the toner resin, while the resin for yellow toner preferably contains no gel. The linear portion is comprised of base resin, preferably unsaturated polyester, in the range from about 50 to about 100 percent by weight of said toner resin, and preferably in the range from about 70 to about 98 percent by weight of said toner resin. The linear portion of the resin preferably comprises low molecular weight reactive base resin that did not crosslink during the cross-linking reaction, preferably unsaturated polyester resin.

The molecular weight distribution of the resin is thus bimodal, having different ranges for the linear and the cross-linked portions of the binder. The number-average molecular weight (Mn) of the linear portion as measured by gel permeation chromatography (GPC) is in the range of from, for example, about 1,000 to about 20,000, and preferably from about 3,000 to about 8,000. The weight-average molecular weight (Mw) of the linear portion is in the range of from, for example, about 4,000 to about 40,000, and preferably from about 5,000 to about 20,000. The weight average molecular weight of the gel portions is, on the other hand, generally greater than 1,000,000. The molecular weight distribution (Mw/Mn) of the linear portion is in the range of from, for example, about 1.5 to about 6, and preferably from about 1.8 to about 4. The onset glass transition temperature (Tg) of the linear portion as measured by differential scanning calorimetry (DSC) is in the range of from, for example, about 50° C. to about 70° C.

This binder resin can provide a low melt toner with a minimum fix temperature of from about 100° C. to about 200° C., preferably about 100° C. to about 160° C., more preferably about 110° C. to about 140° C., provide the low melt toner with a wide fusing latitude to match paper gloss and minimize or prevent offset of the toner onto the rolls in the gloss enhancing module (GEM unit), and maintain high toner pulverization efficiencies. The toner resins and thus toners show minimized or substantially no vinyl offset.

In a preferred embodiment, the cross-linked portion consists essentially of very high molecular weight microgel particles with high density cross-linking (as measured by gel content) and which are not soluble in substantially any solvents such as, for example, tetrahydrofuran, toluene and the like. The microgel particles are highly cross-linked polymers with a very small, if any, cross-link distance. This type of cross-linked polymer may be formed by reacting chemical initiator with linear unsaturated polymer, and more preferably linear unsaturated polyester, at high temperature and under high shear. The initiator molecule breaks into radicals and reacts with one or more double bond or other reactive site within the polymer chain forming a polymer radical. This polymer radical reacts with other polymer chains or polymer radicals many times, forming a highly and directly cross-linked microgel. This renders the microgel very dense and results in the microgel not swelling very well in solvent. The dense microgel also imparts elasticity to the resin and increases its hot offset temperature while not affecting its minimum fix temperature.

Linear unsaturated polyesters used as the base resin are low molecular weight condensation polymers which may be formed by the step-wise reactions between both saturated and unsaturated diacids (or anhydrides) and dihydric alcohols (glycols or diols). The resulting unsaturated polyesters are reactive (e.g., cross-linkable) on two fronts: (i) unsaturation sites (double bonds) along the polyester chain, and (ii) functional groups such as carboxyl, hydroxy, etc., groups amenable to acid-base reactions. Typical unsaturated polyester base resins useful for this invention are prepared by melt polycondensation or other polymerization processes using diacids and/or anhydrides and diols. Suitable diacids and dianhydrides include but are not limited to saturated diacids and/or anhydrides such as for example succinic acid, glutaric acid, adipic acid, pimelic acid, suberic acid, azelaic acid, sebacic acid, isophthalic acid, terephthalic acid, hexachloroendo methylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and the like and mixtures thereof; and unsaturated diacids and/or anhydrides such as for example maleic acid, fumaric acid, chloromaleic acid, methacrylic acid, acrylic acid, itaconic acid, citraconic acid, mesaconic acid, maleic anhydride, and the like and mixtures thereof. Suitable diols include but are not limited to for example propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromo bisphenol dipropoxy ether, 1,4-butanediol, and the like and mixtures thereof, soluble in good solvents such as, for example, tetrahydrofuran, toluene and the like.

Preferred unsaturated polyester base resins are prepared from diacids and/or anhydrides such as, for example, maleic anhydride, fumaric acid, and the like and mixtures thereof, and diols such as, for example, propoxylated bisphenol A, propylene glycol, and the like and mixtures thereof. A most preferred polyester is poly(propoxylated bisphenol A fumarate).

In a most preferred embodiment of the present invention, the toner binder resin comprises either (i) a melt extrusion mixture of (a) linear propoxylated bisphenol A fumarate resin and (b) this resin cross-linked by reactive extrusion of this linear resin, with a gel content of from about 27 to about 37 weight percent, to produce a resin with a gel content of about 5 to about 18 weight percent; or (ii) a reactive extrusion of linear propoxylated bisphenol A fumarate resin to produce a gel content of about 5 to about 18 weight percent. Linear propoxylated bisphenol A fumarate resin is available under the tradename SPARII from Resana S/A Industrias Quimicas, Sao Paulo Brazil, or as Neoxyl P2294 or P2297 from DSM Polymer, Geleen, The Netherlands, for example. For suitable toner storage and prevention of vinyl offset, the polyester resin blend preferably has a glass transition temperature (Tg) of from, for example, 50 to 65° C.

Chemical initiators such as, for example, organic peroxides or azo-compounds are preferred for making the cross-linked toner resins of the invention. Suitable organic peroxides include diacyl peroxides such as, for example, decanoyl peroxide, lauroyl peroxide and benzoyl peroxide, ketone peroxides such as, for example, cyclohexanone peroxide and methyl ethyl ketone, alkyl peroxyesters such as, for example, t-butyl peroxy neodecanoate, 2,5-dimethyl 2,5-di (2-ethyl hexanoyl peroxy) hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-isopropyl mono peroxy carbonate, 2,5-dimethyl 2,5-di (benzoyl peroxy) hexane, oo-t-butyl o-(2-ethyl hexyl) mono peroxy carbonate, and oo-t-amyl o(2-ethyl hexyl) mono peroxy carbonate, alkyl peroxides such as, for example, dicumyl peroxide, 2,5-dimethyl 2,5-di (t-butyl peroxy) hexane, t-butyl cumyl peroxide, bis(t-butyl peroxy) diisopropyl benzene, di-t-butyl peroxide and 2,5-dimethyl 2,5-di (t-butyl peroxy) hexyne-3, alkyl hydroperoxides such as, for example, 2,5-dihydro peroxy 2,5-dimethyl hexane, cumene hydroperoxide, t-butyl hydroperoxide and tamyl hydroperoxide, and alkyl peroxyketals such as, for example, n-butyl 4,4-di (t-butyl peroxy) valerate, 1,1-di (t-butyl peroxy) 3,3,5-trimethyl cyclohexane, 1,1-di (t-butyl peroxy) cyclohexane, 1,1-di (t-amyl peroxy) cyclohexane, 2,2-di (t-butyl peroxy) butane, ethyl 3,3-di (t-butyl peroxy) butyrate and ethyl 3,3-di (t-amyl peroxy) butyrate. Suitable azo-compounds include azobis-isobutyronitrile, 2,2'-azobis (isobutyronitrile), 2,2'-azobis (2,4-dimethyl valeronitrile), 2,2'-azobis (methyl butyronitrile), 1,1'-azobis (cyano cyclohexane) and other similar known compounds.

By permitting use of low concentrations of chemical initiator and utilizing all of it in the cross-linking reaction, usually in the range from about 0.01 to about 10 weight percent, and preferably in the range from about 0.1 to about 4 weight percent, the residual contaminants produced in the cross-linking reaction in preferred embodiments can be minimal. Since the cross-linking can be carried out at high temperature, the reaction is very fast (e.g., less than 10 minutes, preferably about 2 seconds to about 5 minutes residence time) and thus little or no unreacted initiator remains in the product.

The low melt toners and toner resins may be prepared by a reactive melt mixing process wherein reactive resins are partially cross-linked. For example, low melt toner resins may be fabricated by a reactive melt mixing process comprising the steps of: (1) melting reactive base resin, thereby forming a polymer melt, in a melt mixing device; (2) initiating cross-linking of the polymer melt, preferably with a chemical cross-linking initiator and increased reaction temperature; (3) keeping the polymer melt in the melt mixing device for a sufficient residence time that partial cross-linking of the base resin may be achieved; (4) providing sufficiently high shear during the cross-linking reaction to keep the gel particles formed during cross-linking small in size and well distributed in the polymer melt; (5) optionally devolatilizing the polymer melt to remove any effluent volatiles; and (6) optionally adding additional linear base resin after the cross-linking in order to achieve the desired level of gel content in the end resin. The high temperature reactive melt mixing process allows for very fast cross-linking which enables the production of substantially only microgel particles, and the high shear of the process prevents undue growth of the microgels and enables the microgel particles to be uniformly distributed in the resin.

A reactive melt mixing process is a process wherein chemical reactions can be carried out on the polymer in the melt phase in a melt mixing device, such as an extruder. In preparing the toner resins, these reactions are used to modify the chemical structure and the molecular weight, and thus the melt rheology and fusing properties, of the polymer. Reactive melt mixing is particularly efficient for highly viscous materials, and is advantageous because it requires no solvents, and thus is easily environmentally controlled. As soon as the amount of cross-linking desired is achieved, the reaction products can be quickly removed from the reaction chamber.

The resins are generally present in the toner of the invention in an amount of from about 40 to about 98 percent by weight, and more preferably from about 70 to about 98 percent by weight, although they may be present in greater or lesser amounts, provided that the objectives of the invention are achieved.

The toner resins can be subsequently melt blended or otherwise mixed with one or more colorants, an external additive package, and optional charge carrier additives, surfactants, emulsifiers, pigment dispersants, flow additives and the like. The resultant product can then be pulverized by known methods such as milling to form toner particles. If desired, optional waxes with a molecular weight of from about 1,000 to about 7,000, such as polyethylene, polypropylene, and paraffin waxes, may be included in or on the toner compositions as fusing release agents.

Various suitable colorants of any color without restriction can be employed in toners of the invention, including suitable colored pigments, dyes, and mixtures thereof including Carbon Black, such as Regal 330 carbon black (Cabot), Acetylene Black, Lamp Black, Aniline Black, Diarylide Yellow, Sunfast Yellow, Polytone Yellow, Arylide Yellow, Chrome Yellow, Zinc Yellow, Sicofast Yellow, Sunbrite Yellow, Luna Yellow, Novaperm Yellow, Chrome Orange, Bayplast Orange, Cadmium Red, Lithol Scarlet, Rubines, Quanacridones, Rhodamine Lake C, Suntone Magenta, Polytone Magenta, Hostaperm Red, Fanal Pink, Hostaperm Pink, Lithol Red, Rhodamine Lake B, Brilliant Carmine, Suntone Cyan, Polytone Cyan, Heliogen Blue, Hostaperm Blue, Neopan Blue, PV Fast Blue, Phthalocyanine Blue, Cinquassi Green, Hostaperm Green, titanium dioxide, cobalt, nickel, iron powder, Sicopur 4068 FF, and iron oxides such as Mapico Black (Laporte Pigments, Inc.), NP608 and NP604 (Northern Pigment), Bayferrox 8610 (Bayer), M08699 (Mobay), TMB-100 (Magnox), mixtures thereof and the like.

The colorant, preferably black, cyan, magenta and/or yellow colorant, is incorporated in an amount sufficient to impart the desired color to the toner. In general, pigment or dye is employed in an amount ranging from about 2 to about 60 percent by weight, and preferably from about 2 to about 10 percent by weight. In a most preferred embodiment, the yellow, cyan and magenta colorants are provided as pigments predispersed in an additional amount of linear polyester resin. This facilitates mixing of the pigments into the toner binder.

The toners of the present invention include a particular external additive package. It has been found by the present inventors that the composition of the external additive package has a significant effect upon the occurrence of image depletion defects in an image being reproduced. In particular, the present inventors have found that the avoidance of image depletion defects is highly correlated to the developer flow value of the developer, which value is in turn highly correlated to the amount of zinc stearate in the external additive package of the toner.

External additives are additives that associate with the surface of the toner particles. In the present invention, the external additives include at least one of silicon dioxide or silica ($SiO_2$), or titania or titanium dioxide ($TiO_2$). In general, silica is applied to the toner surface for toner flow, triboelectric enhancement, admix control, improved development and transfer stability and higher toner blocking temperature. $TiO_2$ is applied for improved relative humidity (RH) stability, triboelectric control and improved development and transfer stability. In a most preferred embodiment, the external additive package includes both silica and titania.

The $SiO_2$ and $TiO_2$ should preferably have a primary particle size of less than 20 nm. The silica preferably has a primary particle size in the range about 5 to about 10 nm. The titania preferably has a primary particle size in the range about 10 to about 20 nm. Of course, larger size particles may also be used, if desired, for example up to about 50 nm. $TiO_2$ is found to be especially helpful in maintaining development and transfer over a broad range of area coverage and job run length. The $SiO_2$ and $TiO_2$ are preferably applied to the toner surface with the total coverage of the toner ranging from, for example, about 130 to 200% surface area coverage (SAC). Another metric relating to the amount and size of the additives is "SAC×Size" ((surface area coverage) times (the primary particle size of the additive in nanometers)), for which the additives should preferably have a total SAC×Size range between, for example, 1,300 to 2,300.

Most preferably, the $SiO_2$ added is surface treated with HMDS (hexamethyldisilazane). The treated fumed silica is commercially available as TS530 from Cabot Corporation, Cab-O-Sil Division. NA50HS, available from Nippon Aerosil Co., Ltd., may also be used as the silica. The titania may be either treated or untreated. Untreated titanium dioxide is available as P-25 from Degussa. Treated titanium dioxide, for example surface treated with decyltrimethoxysilane is commercially available as MT3103, available from Tayca Corporation.

Zinc stearate (ZnSt) is also necessarily present as an additive in the external additive package for the toners of the invention, the zinc stearate providing lubricating properties. Zinc stearate provides triboelectric enhancement due to its lubricating nature. In addition, zinc stearate enables higher toner charge and charge stability by increasing the number of contacts between toner and carrier particles. Calcium stearate and magnesium stearate may also be present as providing similar functions. A preferred commercially available zinc stearate, having a particle size such that 100% of the material passes through a 325 mesh screen, is known as Zinc Stearate L made by Ferro Corporation, Polymer Additives Division. Other commercially available zinc stearates, such as those available from Synthetic Products Company (Synpro), Fisher Scientific Chemical Division, or the like may also be used.

Zinc stearate is thus a necessary component of the external additive package in order to maintain high and stable triboelectric performance of the developer. The developer of the invention preferably possesses a triboelectric value (as measured by the known Faraday Cage process) of from, for example, 15 to 40 $\mu$C/g. Without zinc stearate as a lubricating external additive, the triboelectric value does not remain stable over the life of the developer, unacceptably decaying over the life of the developer. For example, a comparative toner containing 1.1% by weight NA50HS silica and 0.4% by weight P-25 titania, without any zinc stearate, exhibits a decay of the triboelectric value to 10.0 $\mu$C/g or less after as few as 6,000 copy cycles.

Zinc stearate has been used as an external additive to toner particles. However, it is typically used in relatively high amounts, for example on the order of 0.3 percent by weight of the toner or more. It has been found in the present invention that such higher amounts of zinc stearate result in the occurrence of image depletion defects appearing in solid area images, particularly during long print runs. In particular, it is believed by the present inventors that zinc stearate builds up on the carrier particles over the life of the developer, and may allow the toner particles to adversely pack together (due to the soap-like nature of zinc stearate), thereby significantly hindering the ability of the toner particles to charge and flow freely through the housing assembly of an imaging device. This, in turn, results in depletion of the supply of toner to the development unit, e.g., the magnetic brush, ultimately causing the appearance of image depletion defects in solid image areas due to the insufficient toner supply.

Through extensive research, the inventors have found that (1) elimination of zinc stearate, with or without replacement of other lubricating additives, results in the triboelectric performance of the developer decaying unsatisfactorily over the life of the developer, (2) to substantially eliminate/avoid the occurrence of image depletion defects, it is necessary for the developer to maintain a developer flow value of at least 2.00 $cm^3$/min and (3) maintaining the amount of zinc stearate to about 0.10 percent by weight of the toner or less surprisingly allows high triboelectric performance to be stably maintained, as well as achieves and maintains a developer flow value of at least 2.00 $cm^3$/min during the life of the developer.

The developer flow is measured with a Powder Tester commercially available from Hosokawa Powder Micron Systems using the manufacturer-defined Aerated Density program on the powder tester device, preset to a vibration level of 0.5 mm, and the following procedure. A 25 $cm^3$ calibrated cup is placed on the platform inside the powder tester and a funnel, with an inlet opening of 10 cm and an outlet (or orifice) opening of 4 mm, and brass ring is placed on the vibrating tray. A developer sample of known weight, equivalent to the about 1.2 times the volume of the 25 $cm^3$ calibrated cup, is placed in the funnel with the funnel orifice blocked. The vibration is begun, and the orifice is opened and a timing device is started simultaneously. The time for the entire sample to flow through the orifice is recorded and from the known sample mass and flow time the mass flow rate, in units of grams per minute, is determined. The bulk density of the sample is determined by scraping the top of the calibrated cup to remove excess material and achieve a volume of 25 $cm^3$. The mass of the sample in the cup is determined (in grams), and the bulk density is determined by dividing the mass by 25 $cm^3$. Finally, the volumetric mass flow is determined by dividing the mass flow (in grams per minute) by the bulk density (in grams per $cm^3$) to yield a value in units of $cm^3$ per minute.

Thus, in the present invention, zinc stearate is used as an external additive in an amount of from greater than 0 to no more than about 0.10 percent by weight of the toner, preferably in an amount of from about 0.01 to about 0.10 percent by weight of the toner.

Most preferably, the external additive package comprises titanium dioxide in an amount of about 0.3 to about 5.0 percent by weight of a total weight of the toner, silicon dioxide in an amount of about 0.1 to about 3.0 percent by weight of the total weight of the toner, and zinc stearate in an amount of about 0.01 to about 0.10 percent by weight of the total weight of the toner.

By the developer maintaining a flow value of at least 2.00 $cm^3$/min, the developer flows adequately through the housing assembly to sufficiently supply the development unit (magnetic brush) with toner so as to avoid the occurrence of image depletion defects over the life of the developer. In other words, a flow value of at least 2.00 $cm^3$/min permits the toner concentration on the magnetic brush to remain at a level near or equal to the toner concentration level at the point in the xerographic developer housing where toner is dispensed into the developer. For example, if the toner concentration in the developer housing at the point of toner dispense is about 6%, a developer flow value of greater than 2.00 $cm^3$/min permits the free exchange of developer between the magnetic roll and other areas of the developer housing so as to maintain a toner concentration above about 5.5% over the length of the magnetic roll. If the developer flow value is below 2.00 $cm^3$/min, the developer is not free to exchange with the developer in other areas of the housing, and the toner is rapidly depleted from the developer on the magnetic roll, causing a low toner concentration which may be non-uniform across the length of the magnetic roll. Specifically, the toner concentration can near 6% at the point on the magnetic roll nearest to the point at which toner is dispensed in the housing and be less than 3% at the point on the magnetic roll farthest from the point at which toner is dispensed in the housing. This area of the magnetic roll depleted in toner concentration will not adequately develop the image on the photoreceptor, causing the depletion defect to become manifest.

For further enhancing the negative charging characteristics of the developer compositions described herein, and as optional components there can be incorporated into the toner or on its surface charge enhancing additives inclusive of aluminum complexes, like BONTRON E-88, and the like and other similar known charge enhancing additives. Also, positive charge enhancing additives may also be selected, such as alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; bisulfates, and the like. These additives may be incorporated into the toner in an amount of from about 0.1 percent by weight to about 20 percent by weight, and preferably from 1 to about 3 percent by weight.

The toner composition of the present invention can be prepared by a number of known methods including melt blending the toner resin particles, and pigment particles or colorants followed by mechanical attrition. Other methods include those well known in the art such as spray drying, melt dispersion, dispersion polymerization, suspension polymerization, and extrusion.

The toner is preferably made by first mixing the binder, preferably comprised of both the linear resin and the cross-linked resin as discussed above, and the colorant together in a mixing device, preferably an extruder, and then extruding the mixture. The extruded mixture is then preferably micronized in a grinder along with about 0.3 to about 0.5 weight percent of the total amount of silica to be used as an external additive. The toner is then classified to form a toner with the desired volume median particle size and percent fines as discussed above. Care should also be taken in the method in order to limit the coarse particles, grits and giant particles. Subsequent toner blending of the remaining external additives is preferably accomplished using a mixer or blender, for example a Henschel mixer, followed by screening to obtain the final toner product.

In a preferred embodiment of the invention, the finished toner particles have an average particle size (diameter) of from about 7.8 to 8.3 microns, most preferably of from about 7.9 to 8.2 microns, as measured by the well known Coulter counter technique. Most preferably, no more than 8% have a size less than 5 microns measured by number and no more than 1% have a size greater than 16 microns measured by volume.

In order to provide toners which meet the gloss requirements for the fused image and do not hot offset to the rolls of the gloss enhancing module (GEM unit) in the device, the toners preferably have a melt viscosity at 100° C. of, for example, 35,000 to 70,000 poise; at 125° C. of, for example, 2,300 to 7,000 poise; and, at 150° C. of, for example, 800 to 2,000 poise. The melt viscosities were measured with a rheometer (model RMS-800, made by Rheometrics, Inc.) at 40 radians per second. This narrow range of melt viscosity profile will provide the required minimum fix, appropriate gloss and the desired hot offset behavior, enabling long roll life in the magnetic brush development system.

The charge of a toner is described in terms of the charge/particle diameter, Q/D, in fC/$\mu$m following triboelectric contact of the toner with carrier particles. The charge per particle diameter (Q/D) of the toner particles has an average value of from, for example, 0.3 to 1.1, preferably from 0.6 to 0.9 fC/$\mu$m. This charge should preferably remain stable throughout the development process in order to insure consistency in the richness of the images obtained using the toner.

The measurement of the average Q/D of the toner particles can be done by means of a charge spectrograph apparatus as well known in the art. See, for example, U.S. Pat. No. 4,375,673, incorporated herein by reference. The spectrograph is used to measure the distribution of the toner particle charge (Q in fC) with respect to a measured toner diameter (D in $\mu$m). The measurement result is expressed as percentage particle frequency (in ordinate) of same Q/D ratio on Q/D ratio expressed as fC/$\mu$m (in abscissa).

Each of the resulting colors of toner particles can then be formulated into developer compositions. Preferably, the toner particles are mixed with carrier particles to achieve a two-component developer composition.

Suitable and preferred materials for use as carriers used in preparing developers containing the above-discussed toners of the invention that possess the properties discussed above will now be discussed. The toner particles triboelectrically adhere to the surface of the carrier particles.

Illustrative examples of carrier particles that can be selected for mixing with the toner composition prepared in accordance with the present invention include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers are disclosed in U.S. Pat. Nos. 4,937,166 and 4,935,326, the disclosures of which are hereby totally incorporated herein by reference.

In a preferred embodiment, the carrier core is comprised of ferrite particles. The ferrite particles may be substantially free of both zinc and copper. Such ferrite particles are described in co-pending U.S. patent application Ser. No. 09/444,701, filed Nov. 24, 1999, incorporated herein by reference in its entirety. As explained in the co-pending application, by "substantially free of" is meant that the ferrite particles contain less than 2,000 ppm copper and less than 4,000 ppm zinc on a weight basis of the ferrite particle, which values correspond approximately to less than 0.25 wt.% copper oxide and less than 0.50 wt.% zinc oxide on the basis of the overall ferrite particle weight.

The ferrite particles may be Mn-Mg-Sr ferrite particles. Such ferrite particles may be commercially obtained, for example, from Powdertech and are known as EFA60, EF-B75, EF-B65, EF-B55, and EF-C30 or as a proprietary material known as PXC-150.

The carrier particles to be used as cores in the invention preferably have an average particle size (diameter) of from, for example, 10 to 100 microns, preferably 30 to 80 microns, most preferably 45 to 55 microns, as determined by standard laser diffraction techniques. In addition, the core particles have a magnetic saturation of, for example, 30 to 110 emu/g, preferably 40 to 100 emu/g, more preferably 50 to 75 emu/g, most preferably 60 to 65 emu/g, a powder density as determined by ASTM Test B-212-89 of 2.0 to 3.0 g/cm$^3$, preferably 2.2 to 2.5 g/cm$^3$, most preferably about 2.40 g/cm$^3$, a conductivity of 2 to $10\times10^{-10}$ (ohm-cm)$^{-1}$, most preferably of about $6\times10^{-1}$ (ohm-cm)$^{-1}$ and a breakdown voltage of 700 to 1000 V, most preferably of about 850 V. The conductivity of the core is measured by applying a 200 Volt fixed voltage across a 0.1 inch magnetic brush in a static (non-rotating) mode. The resultant current flow through the material is used to calculate the conductivity of the core. The voltage breakdown of the core is measured by applying a fixed rate of increasing voltage across 0.1 inch magnetic brush while under rotation. The applied voltage at which 100 microamps of current flows through the sample is defined as the breakdown voltage. See, for example, U.S. Pat. No. 5,196,803, incorporated herein by reference.

The selected carrier particles can be used with or without a coating, the coating generally being comprised of fluoropolymers, such as polyvinylidene fluoride resins, terpolymers of styrene, methyl methacrylate, a silane, such as triethoxy silane, tetrafluorethylenes, mixtures thereof, other known coatings and the like.

In a preferred embodiment of the invention, the ferrite particles are coated with a mixture of at least two dry polymer components, which dry polymer components are preferably not in close proximity thereto in the triboelectric series, and most preferably of opposite charging polarities with respect to the toner selected.

The electronegative polymer, i.e., the polymer that will generally impart a positive charge on the toner which it is contacted with, is preferably comprised of a polyvinylidenefluoride polymer or copolymer. Such polyvinylidenefluoride polymers are commercially available, for example under the tradename Kynar from Elf Atochem. Kynar 301F, a proprietary version of Kynar 500, is polyvinylidenefluoride and Kynar 201, a proprietary version of Kynar 460, is copolyvinylidenefluoride tetrafluoroethylene.

The electropositive polymer, i.e., the polymer that will generally impart a negative charge on the toner which it is contacted with is preferably comprised of a polymer or copolymer of polymethyl methacrylate (PMMA), optionally having carbon black or another conductive material dispersed therein. PMMA by itself is an insulative polymer. To obtain conductive PMMA, a conductive component, for example carbon black, is dispersed in the polymer. The PMMA may be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate; and the like. If the PMMA polymer has carbon black dispersed therein, it is preferably formed in a semisuspension polymerization process, for example as described in U.S. Pat. No. 5,236,629, incorporated by reference herein in its entirety. The PMMA polymer may have a weight average molecular weight of from, for example, 300,000 to 350,000, such as a PMMA commercially available from Soken.

The percentage of each polymer present in the carrier coating mixture can vary depending on the specific components selected, the coating weight and the properties desired. In particular, the ratios of the two polymers may be varied in order to adjust the triboelectric characteristics of the carrier in order to meet the particular $A_T$ requirements of a given printing device. Generally, the coated polymer mixtures used contain from about 3 to about 97 percent of the electronegative polymer, and from about 97 to about 3 percent by weight of the electropositive polymer. Preferably, there are selected mixtures of polymers with from about 3 to 25 percent by weight of the electronegative polymer, and from about 97 to 75 percent by weight of the electropositive polymer. Most preferably, there are selected mixtures of polymers with from about 5 to 20 percent by weight of the electronegative polymer, and from about 95 to 80 percent by weight of the electropositive polymer.

The carrier particles may be prepared by mixing the carrier core with from, for example, between about 0.05 to about 10 percent by weight, most preferably between about 0.3 percent and about 0.5 percent by weight, based on the weight of the coated carrier particles, of the mixture of dry polymers until adherence thereof to the carrier core by mechanical impaction and/or electrostatic attraction. The mixture of carrier core particles and polymers is then heated to a temperature of, for example, between from about 200° F. to about 650° F., preferably 320° F. to 550° F., most preferably 380° to 420° F., for a period of time of from, for example, about 10 minutes to about 60 minutes, enabling the polymers to melt and fuse to the carrier core particles. The coated carrier particles are then cooled and thereafter classified to a desired particle size. The coating preferably has a coating weight of from, for example, 0.1 to 3.0% by weight of the carrier, preferably 0.1 to 1.0% by weight.

Various effective suitable means can be used to apply the polymer mixture coatings to the surface of the carrier core particles. Examples of typical means for this purpose include combining the carrier core material and the mixture of polymers by cascade roll mixing, or tumbling, milling, shaking, electrostatic powder cloud spraying, fluidized bed, electrostatic disc processing, and an electrostatic curtain. Following application of the polymer mixture, heating is initiated to permit spreading of the coating material over the surface of the carrier core. The concentration of the coating material powder particles, as well as the parameters of the heating step, may be selected to enable the formation of a continuous film of the coating material on the surface of the carrier core, or permit only selected areas of the carrier core to be coated.

Two component developer compositions of the present invention can be generated by mixing the carrier core particles with a toner composition comprised of resin particles and pigment particles.

It is desirable to maintain a ratio of carrier volume median diameter to toner volume median diameter of approximately 5:1 to 7:1, preferably of about 6:1. The finished coated carrier particles thus should have an average particle size (diameter) of from, for example, 40 to 55 microns, as determined by standard laser diffraction techniques. Most preferably, less than 3% of the carrier particles have a size smaller than 31 microns, 10% or fewer carrier particles have a size smaller than 36 microns and 10% or fewer carrier particles have a size larger than 72 microns.

The carrier particles can be mixed with the toner particles in various suitable combinations. However, best results are obtained when about 1 part to about 5 parts by weight of toner particles are mixed with from about 10 to about 300 parts by weight of the carrier particles, preferably when 3 to 5 parts by weight of toner particles are mixed with from 90 to 110 parts by weight of the carrier particles. The toner concentration in the developer initially installed in a xerographic development housing is thus preferably between, for example, 3 and 6 percent by weight based on the total developer weight.

In a most preferred embodiment of the present invention, the developers are used to develop latent images using a magnetic brush development system such as discussed above. Such a system typically has a machine functional requirement of $A_T$ of about 300 to $500\times10^{-2}$ $\mu$C/g. $A_T$ is a convenient way to quantify the charging ability properties of a developer. The minimum $A_T$ value of an imaging device is that $A_T$ of a developer below which imaging with the developer in the device fails (because, for example, the charge of the toner is so low that the background on the print is visible or too much toner is developed in the image areas causing image quality degradation). $A_T$ is defined as (magnitude of q/m of toner in the developer)×(toner concentration of developer+an offset value). For an imaging device utilizing the toner and developer of the present invention, the offset value is about 8 and the minimum $A_T$ required for good print quality and a clean machine is around $300\times10^{-2}$ $\mu$C/g, for example. Using developers with $A_T$ less than $300\times10^{-2}$ $\mu$C/g, might result in machine dirt, high background or fuzzy images caused by toner pushed or dragged outside the image. These values can be derived by well known techniques in the art. See, for example, R. J. Nash and J. T. Bickmore, 4$^{th}$ *Intl. Cong. On Adv. In Non-Impact Printing Tech., R. J. Nash*, ed., IS&T, Springfield, Va., ppl 13–26 (1988); E. J. Gutman and G. C. Hartmann, J. Imaging Sci. & Tech. 36, 4, 335 (1992).

Thus, the developers of the invention preferably have an $A_T$ of from 300 to $500\times10^{-2}\mu$C/g. The $A_T$ must remain stable over the life of the developer so that the images obtained from the developer over its life remain consistent (i.e., have consistently high quality). The life of the developer is typically at least, for example, 200,000 A4 prints.

The developers are most preferably insulative in order to avoid shorting if the photoreceptor surface is scratched and to achieve lower development gamma. The developers are insulating by the choice of carrier design. The carriers have a breakdown voltage greater than 1,700 volts and conductivity of about $1\times10^{-11}$ to about $1\times10^{-10}$ (ohm-cm)$^{-1}$ at 200 volts as measured in a magnetic brush conductivity cell (see, for example, U.S. Pat. No. 5,196,803, incorporated herein by reference). In particular, the developer preferably possesses a triboelectric value (as measured by the known Faraday Cage process) of from, for example, 15 to 40 $\mu$C/g, as well as exhibit triboelectric stability over the life of the developer.

The conductivity of the developer is primarily driven by the carrier conductivity. To achieve a low conductivity carrier, nearly complete, i.e., greater than 40% coverage of the surface, coatings of polymers are used to cover the carrier core. Additionally, more spherically shaped carrier cores lower the conductivity of the developer.

The developers of the invention exhibit triboelectric stability, solid area density stability, sufficient developer flow and excellent gloss.

EXAMPLE 1

In this Example, triboelectric values and developer flow values for toners and developers of the invention are evaluated. The toners evaluated contain 4.1% by weight NA50HS silica as the only particulate external additive and a certain amount of zinc stearate on a magenta base toner. The carrier which is paired with the toner to make the developer consists of a 50 $\mu$m diameter Mn-Mg-Sr ferrite core particle coated with 0.4% by weight of a polymer mixture, with the polymer mixture containing 80% polymethylmethacrylate and 20% Kynar 301F by weight. The developer is comprised of 95% carrier and 5% toner on a weight basis.

The flow values were determined using the Hosokawa Powder Tester and the procedure as described above.

For a first toner containing 0.05% by weight zinc stearate, the virgin developer exhibits a flow rate of 3.23 cm$^3$/min. The developer is then aged by placing it in a DocuColor 70 developer housing and placing the housing in a fixture external to the DC70 xerographic engine and driving the housing at the nominal rotational speed without the addition or removal of toner from the housing, in a manner commonly referred to as non-toner throughput aging. After 2 hours of aging, which corresponds to approximately 4,200 prints in a normal machine operating condition, the developer flow value is still 3.00 cm$^3$/min, a value substantially above that necessary to prevent the depletion image quality defect. When this developer is run in a DC70 machine, the $A_T$ value is found to be stable as a function of time up to 10 kp, achieving a value of between 320 and $400\times10^{-2}$ $\mu$C/g.

For a second toner containing 0.10% by weight zinc stearate, the virgin developer exhibits a flow rate of 3.20 $cm^3$/min, approximately the same value as that of the toner containing 0.05% ZnSt. After 2 hours of aging in the same non-toner throughput manner as described above, the developer flow value is 2.30 $cm^3$/min. Although this value is still above the 2.00 $cm^3$/min value necessary to prevent the depletion defect from occurring during the normal operating mode of the machine, it is substantially below that of the value of 3.00 $cm^3$/min achieved under the same conditions with using only 0.05% ZnSt. When this developer is run in a DC70 machine, the $A_T$ value is found to rise slightly as a function of time, beginning at about $350\times10^{-2}$ $\mu$C/g and rising to a value of greater than $500\times10^{-2}$ $\mu$C/g by 9 kp.

Both toners thus maintain a satisfactory flow value, although it is apparent that as the amount of zinc stearate increases, the developer flow value decreases.

COMPARATIVE EXAMPLE 1

In this Comparative Example, print quality and developer flow values for a toner and developer are evaluated. The toner evaluated contains 0.6% by weight TS530 treated silica, 1.5% P25 untreated titania, and 0.3% zinc stearate blended onto a black base toner. The carrier which is paired with the toner to make the developer consists of a 50 $\mu$m diameter Mn-Mg-Sr ferrite core particle coated with 0.4% by weight of a polymer mixture, with the polymer mixture containing 95% polymethylmethacrylate and 5% Kynar 301F by weight. The developer is comprised of 96% carrier and 4% toner on a weight basis. The flow value of the virgin developer, that is one which has not been subjected to any aging in either a xerographic machine or housing external to the machine, is determined with a Hall flowmeter as described above. This virgin developer exhibits a flow rate of about 3.8 $cm^3$/min.

The developer is then installed in a DocuColor 70 machine and in a normal machine operating mode. After the machine has printed approximately 48,000 prints without any noticeable image quality shortfalls, the density depletion defect is first observed, which increased in magnitude over the subsequent 1,000 prints. The increase in magnitude occurs in both the spatial extent of the defect, which is increased, and in the difference in developed toner mass within the defect area degree of depletion, which is also increased. The $A_T$ value is stable at about $400\times10^{-2}$ $\mu$C/g over the approximately 50 kp developer life. The developer is then removed from the machine and the flow value is determined in the Hall flowmeter to be approximately 1.1 $cm^3$/min, with the developer comprised of 94% carrier and 6% toner on a weight basis.

COMPARATIVE EXAMPLE 2

In this Comparative Example, triboelectric values and developer flow values for toners and developers are evaluated. The toner evaluated contains 1.1% by weight NA50HS treated silica, 0.4% P25 untreated titania blended onto a black base toner. This toner has no ZnSt component in the external additive package formulation. The carrier which is paired with the toner to make the developer consists of a 50 $\mu$m diameter Mn-Mg-Sr ferrite core particle coated with 0.4% by weight of a polymer mixture, with the polymer mixture containing 95% polymethylmethacrylate and 5% Kynar 301F by weight. The flow value of the virgin developer, that is one which has not been subjected to any aging in either a xerographic machine or housing external to the machine, is determined with a Hall flowmeter as discussed above. This virgin developer exhibits a flow rate of 4.2 $cm^3$/min.

The developer is then aged by placing it in a mixing device which simulates developer mixing in a DocuColor 70 developer housing and the mixing device is rotated at a set speed without the addition or removal of toner from the housing, in a manner commonly referred to as non-toner throughput aging. After 2 hours of aging, which correspond to approximately 4,200 prints in a normal machine operating condition, the developer flow value is 5.3 $cm^3$/min, a value substantially above that necessary to prevent the depletion image quality defect. However, when this developer is run in a DC70 machine in a normal operating mode, that is, one in which xerographic prints are made and toner throughput is present in the device, the $A_T$ value is found to be very unstable as a function of time up, beginning at a value of approximately $220\times10^{-2}$ $\mu$C/g shortly after the developer install and rapidly decaying to a value of less than $90\times10^{-2}$ $\mu$C/g after a print count of 7,400 prints.

EXAMPLE 2

In this Example, xerographic print quality, triboelectric values and developer flow values for toners and developers of the invention are evaluated. The toners evaluated contain 0.88% by weight TS530 treated silica, 0.68% MT3103 treated titania, and 0.05% zinc stearate. This external additive package is blended onto black, cyan, yellow, and magenta base toners. The carrier which is paired with each of these toners to make the four corresponding developers consists of a 50 $\mu$m diameter Mn-Mg-Sr ferrite core particle coated with 0.4% by weight of a polymer mixture, with the polymer mixture containing 80% polymethylmethacrylate and 20% Kynar 301F by weight. The flow values of the virgin developers are determined with a Hall flowmeter as discussed above. These virgin developers exhibit flow rates of 4.53, 4.16, 4.74, and 4.29 $cm^3$/min for the cyan, magenta, yellow, and black developer, respectively.

The developers are then aged by placing each in a mixing device which simulates developer mixing in a DocuColor 70 developer housing and the mixing device is rotated at a set speed without the addition or removal of toner from the housing, in a manner commonly referred to as non-toner throughput aging. After 2 hours of aging, which corresponds to approximately 4,200 prints in a normal machine operating condition, the developer flow values are still 4.36, 2.81, 4.90, and 3.44 $cm^3$/min for the cyan, magenta, yellow, and black developer, respectively. These values are all substantially above that necessary to prevent the depletion image quality defect.

The developers are also installed in both DocuColor 70 and DocuColor 100 machines and run in a normal machine operating mode. After approximately 150,000 prints in both xerographic machines, the prints remain free of depletion image quality defects and the triboelectric values are stable and the $A_T$ values are between 250 and $400\times10^{-2}$ $\mu$C/g.

Although the invention has been described with reference to specific preferred embodiments, it is not intended to be limited thereto. Rather, those having ordinary skill in the art will recognize that variations and modifications may be made therein which are within the spirit of the invention and within the scope of the claims.

What is claimed is:

1. A developer comprising toner particles and carrier particles, wherein the developer has and maintains a flow rate of at least about 2 $cm^3$/min and the toner particles comprise at least one binder, at least one colorant, and an external additive package comprised of zinc stearate and at least one of silicon dioxide or titanium dioxide, wherein the zinc stearate is present in an amount of from greater than 0 to no more than about 0.1 percent by weight of the toner, wherein further the toner particles have a size distribution such that no more than about 8% of a total number of particles have a size less than about 5 microns and no more than about 1% of a total volume of toner particles have a size greater than about 16 microns, and the carrier particles are substantially free of copper and zinc and are coated with a coating comprising a polyvinylidenefluoride polymer or copolymer and a polymethyl methacrylate polymer or copolymer.

2. The developer according to claim 1, wherein the zinc stearate is present in an amount of from about 0.01 to about 0.10 percent by weight of the toner.

3. The developer according to claim 1, wherein the external additive package includes all of zinc stearate, silicon dioxide and titanium dioxide.

4. The developer according to claim 1, wherein the toner particles have an average particle diameter of from about 7.8 to about 8.3 microns.

5. The developer according to claim 1, wherein the external additive package comprises titanium dioxide in an amount of about 0.3 to about 5.0 percent by weight of a total weight of the toner, silicon dioxide in an amount of about 0.1 to about 3.0 percent by weight of the total weight of the toner, and zinc stearate in an amount of about 0.01 to about 0.10 percent by weight of the total weight of the toner.

6. The developer according to claim 1, wherein the external additive package has a SAC×size ((surface area coverage in percent)×(primary particle size of the external additive in nanometers)) of from 1,300 to 2,300.

7. A developer comprising toner particles and carrier particles, wherein the developer has and maintains a flow rate of at least about 2 $cm^3$/min, and the toner particles are comprised of at least one binder resin comprising a propoxylated bisphenol A fumarate resin, at least one colorant comprising pigment selected from the group consisting of cyan, yellow, magenta and black, wherein if the pigment is cyan, magenta or black, the binder resin has a gel content of from about 5 to about 18 percent by weight of the binder resin and if the pigment is yellow, the binder resin contains no gel, and an external additive package comprised of zinc stearate and at least one of silicon dioxide or titanium dioxide, wherein the zinc stearate is present in an amount of from greater than 0 to no more than about 0.1 percent by weight of the toner.

8. The developer according to claim 7, wherein the at least one binder resin comprises about 70 to about 98 percent by weight of a total weight of the toner and wherein the at least one colorant comprises about 2 to about 10 percent by weight of the total weight of the toner.

9. The developer according to claim 7, wherein the zinc stearate is present in an amount of from about 0.01 to about 0.10 percent by weight of the toner.

10. The developer according to claim 7, wherein the external additive package includes all of zinc stearate, silicon dioxide and titanium dioxide.

11. The developer according to claim 7, wherein the external additive package comprises titanium dioxide in an amount of about 0.3 to about 5.0 percent by weight of a total weight of the toner, silicon dioxide in an amount of about 0.1 to about 3.0 percent by weight of the total weight of the toner, and zinc stearate in an amount of about 0.01 to about 0.10 percent by weight of the total weight of the toner.

12. The developer according to claim 1, wherein a ratio of carrier volume median diameter to toner volume median diameter is from about 5:1 to about 7:1, and wherein a toner concentration in the developer is from about 1 to about 10 percent by weight based on a total weight of the developer.

13. The developer according to claim 7, wherein the carrier particles comprise a core of ferrite having a size of from about 30 to about 60 micrometers in diameter.

14. The toner according to claim 1, wherein the zinc stearate is present in an amount of about 0.1 percent by weight of the toner.

15. The toner according to claim 1, wherein the zinc stearate is present in an amount of from greater than 0 to 0.05 percent by weight of the toner.

16. The developer according to claim 7, wherein the zinc stearate is present in an amount of about 0.1 percent by weight of the toner.

17. The developer according to claim 7, wherein the zinc stearate is present in an amount of from greater than 0 to 0.05 percent by weight of the toner.

* * * * *